United States Patent [19]

Stoller, Sr. et al.

[11] 4,454,823

[45] Jun. 19, 1984

[54] BULK FREIGHT RAIL CAR WITH METALLIZED INTERIOR SURFACES

[75] Inventors: David A. Stoller, Sr., Dunwoody; William B. Culler, Norcross; Paul E. Wiesner, Cumming, all of Ga.

[73] Assignee: Portec, Inc., Oak Brook, Ill.

[21] Appl. No.: 309,705

[22] Filed: Oct. 8, 1981

[51] Int. Cl.[3] ..... B61D 17/18

[52] U.S. Cl. ..... 105/423; 428/550; 428/553; 428/653; 428/937

[58] Field of Search ..... 428/653, 937, 550, 551, 428/553; 105/423; 202/262, 267 R

[56] References Cited

U.S. PATENT DOCUMENTS

| | | | |
|---|---|---|---|
| 2,076,005 | 4/1937 | Sanford | 105/247 |
| 3,142,265 | 7/1964 | Ford | 105/423 |
| 3,572,252 | 3/1971 | Coover et al. | 105/406 R |
| 3,932,144 | 1/1976 | Matsubara et al. | 428/653 |

FOREIGN PATENT DOCUMENTS

| | | | |
|---|---|---|---|
| 218393 | 1/1910 | Fed. Rep. of Germany | 105/255 |

OTHER PUBLICATIONS

*Aluminum For More Efficient Railroad Cars*, The Aluminum Association, pp. 2, 3, 17 (1/80).

Johnson, R. E.; "Unit Train Coal Car Design Considerations", pp. 1, 6, 7; Paper Presented ASME/IEEE Railroad Conference, Apr. 28–30, 1981.

Lyman, T., Ed.; *Metals Handbook* 8th Ed., vol. II; Am. Soc. for Metals, pp. 489–491, 493–497, (1964).

*Primary Examiner*—Michael L. Lewis

*Attorney, Agent, or Firm*—Emory L. Groff, Jr.

[57] ABSTRACT

A railcar for transporting coal includes steel sheets metallized with an aluminum coating on the interior surfaces thereof normally engaged by coal lading. A coating thickness of substantially 0.006–0.009 inch significantly extends the service life of the railcar by inhibiting corrosion and abrasion of the steel sheets by the coal. The method includes the steps of cleaning all interior surfaces of the railcar sheets prior to a metallizing operation and followed by application of a seal coat.

3 Claims, 6 Drawing Figures

BULK FREIGHT RAIL CAR WITH METALLIZED INTERIOR SURFACES

This invention relates generally to railcars having a particular coating on the interior of the sheets and more particularly, to an improved freight car wherein steel sheets of the car are provided with a spray-coated layer of substantially pure aluminum on the interior surfaces thereof.

The material comprising the sheets of railcars designed for the transport of bulk freight such as coal, are subjected to a high degree of corrosion and abrasion which substantially limits the service life of the conventional railcar constructed of steel sheets. Obviously, oxidation of steel sheets is an on-going process and is accelerated by the abrasive action generated by the coal lading. The loading, unloading and shifting of the coal during transport over the rails causes the irregularly-configured coal lumps to abrade the confining interior surface of the railcar sheets, with such abrasion readily removing superficial oxidation which thereafter exposes more of the steel sheets to subsequent oxidation and wearing away of the sheet thickness. The deterioration of the structural integrity of the railcar sheets is affected by corrosive action inherently produced as a result of the formation of sulphuric acid from the natrually-moist coal. Thus, it will be appreciated that coal lading in a steel sheeted railcar consistently subjects the sheets to the deleterious effects of corrosion and abrasion to significantly shorten the useful life of the railcar. This is not to say that after a certain period of time when the car sheets have been reduced in thickness to a critical point that the entire car will be turned into scrap. Many cars reaching this stage are periodically reconditioned by replacement of the side sheets, end sheets and slope sheets in order to obtain additional service life, but quite obviously, this reconditioning entails considerable expense and unprofitable downtime.

It has been observed that a typical coal car has a service life of 8 to 12 years when subjected to high sulphur coal while a low sulphur coal lading extends this service life to between 29 and 40 years. These figures disregard the possibility of structural failures in the railcars before one-half the original thickness of the high-strength low-alloy sheets is lost.

Prior solutions to the problem of providing improved railcars for transporting coal have included the fabrication of the railcars sheets of an alternate metal which will not exhibit such a high degree of corrosion and abrasion as has been found when utilizing the conventional carbon steel sheets. Stainless steel and aluminum sheets have been employed and although such sheets have exhibited a negligible material loss, the investment return on the added cost of constructing railcars using sheets of these metals is questionable. Other problems are also prevalent in the area of fabrication techniques as well as in steel-to aluminum joint design.

The instant invention proposes the application of a specific metal coating upon the interior surfaces of the sheets of an existing steel railcar body. More particularly, the interior surfaces are metallized by means of a spray-coating apparatus with a specific coating, namely aluminum, which has been found to provide a coal-carrying railcar having the greatest resistance to corrosion and abrasion per cost involved, per anticipated service life although other protective coatings that may be applied are zinc and stainless steel.

Other, prior attempts to modify coal carrying railcars to reduce the effects of corrosion and abrasion will be found in U.S. Pat. Nos. 1,556,757 issued Oct. 13, 1925 and 2,076,005 issued Apr. 6, 1937. U.S. Pat. No. 1,556,757 teaches the construction of the sheets of coal-carrying hopper or gondola railcars of a copper-bearing steel to resist the corrosion effects of sulphuric acid associated with coal lading. U.S. Pat. No. 2,076,005 proposes the provision of chromium nickel steel layers on the sheets of a coal-carrying railcar to offer a highly polished surface yeilding minimum frictional resistance to coal disposed upon the slope sheets. The initial construction of railcars from a modified steel composition as well as cladded or combined disparate layers of metal sheets has been found to be far too expensive, and additionally these methods are not adaptable to the modification of existing railcars provided with sheets formed from high-strength low-alloy steels.

Accordingly, one of the objects of the present invention is to provide an improved coal-carrying railcar having steel sheets provided with a spray-coated aluminum layer on the interior surfaces thereof.

Another object of the present invention is to provide an improved coal-carrying railcar having an aluminum metallized interior surface.

A further object of the present invention is to provide an improved method for adapting a steel sheeted railcar for a more efficient handling of coal lading comprising the steps of cleaning and roughing the interior surfaces of the car sheets followed by the spray coating of aluminum thereon and having a thickness of at least 0.006 inches.

With these and other objects in view, which will more readily appear as the nature of the invention is better understood, the invention consists in the novel construction, combination and arrangement of parts hereinafter more fully described, illustrated and claimed.

Similar reference characters designate corresponding parts throughout the several figures of the drawing.

Figure 1:
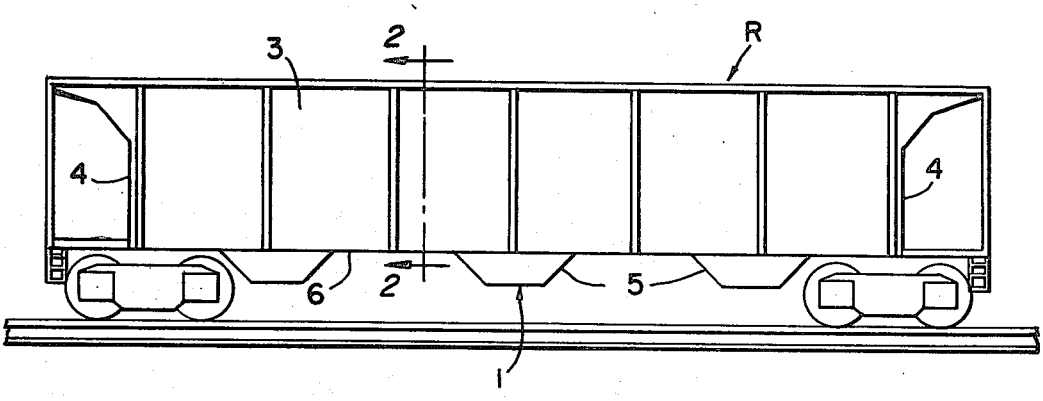
FIG. 1 is a side elevation of a coal-carrying railcar according to the present invention.
Figure 2:
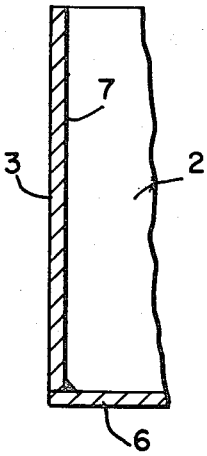
FIG. 2 is a fragmentary transverse cross-section taken along the line 2—2 of FIG. 1.

The metallized railcar R of the present invention is shown in FIG. 1 of the drawing as a bottom discharging hopper car containing a plurality of hopper discharge assemblies 1. For the purpose of this invention, it will be appreciated that the railcar R may comprise a hopper car or gondola car or any other suitable coal conveying railcar as the inventive concept herein is associated with the construction of the sheets thereof which are arranged to define the interior of the car.

As shown, the railcar comprises opposite side sheets 3 bounded by opposed end sheets 4 and in the case of a hopper car, will include appropriate slope sheets 5. The bottom of the car is bounded by either a plurality of the hopper discharging assemblies 1 and/or a floor sheet 6. Each of the car sheets 3–6 includes an interior suface 7 defining the car interior 2. As indicated earlier, the instant invention involves a modification of an existing railcar the sheets of which are constructed of a high-strength low-alloy steel. The fabrication of an initial railcar from sheets which have already been metallized according to this invention would present numerous difficulties foremost of which would be maintenance of the integrity of the coating during such fabrication. Additionally, any such coating as now proposed, would be damaged by the numerous welds applied during fabrication and then these welds themselves would be devoid of the present spray coating. On the other hand, it will be appreciated that the fabricated railcar employed in producing the present invention may comprise a new as well as a used railcar. An advantage to applying the present process to a new car after its assembly is that the longer life provided by the aluminizing would allow use of a less costly steel for the railcar sheets. As an example, instead of utilizing a high-strength low-alloy steel as now often used to provide a railcar having a degree of corrosion resistance, a less costly carbon steel such as A-36 may be used and suitably corrosion protected according to the instant process. Such a substitution of material would yield a cost reduction of approximately $0.05 per pound.

Figure 3:
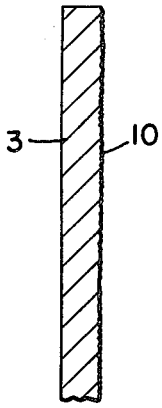
FIG. 3 is a fragmentary cross-section of one of the railcar sheets following preparation for the metallizing step.
Figure 4:
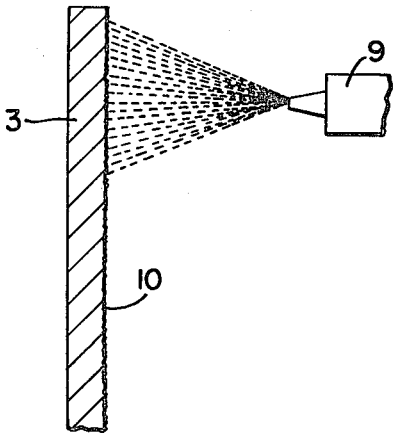
FIG. 4 is a view similar to FIG. 3 and illustrates the spray coating of a disparate metal upon the sheets.
Figure 5:
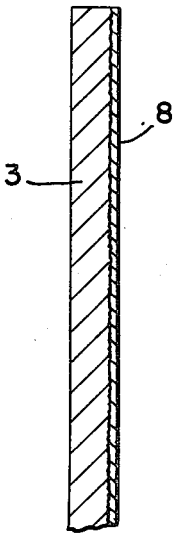
FIG. 5 is a view similar to FIGS. 3 and 4 and illustrates the applied spray coating.
Figure 6:
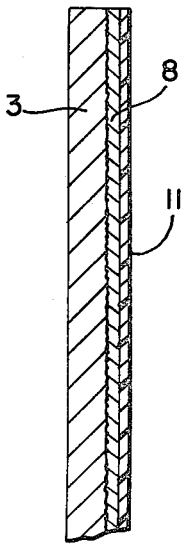
FIG. 6 is a view similar to FIG. 5 and illustrates the subsequently applied outer-most seal coat.

The interior surfaces 7 of each of the sheets comprising the railcar are metallized with an aluminum coating which is applied by any suitable metallizing apparatus such as the spray gun 9 shown in FIG. 4. Prior to this metallizing step, the base steel surface of the various car sheets is prepared by grit blasting the interior surfaces 7 thereof to provide the cleaned, roughened, prepared surface 10 as shown in FIG. 3. The etched nature of the roughened surface 10 is preferably achieved by blasting with angular silica sand or crushed garnet having a mesh size of 20 to 40.

Following the preparatory step of FIG. 3, the metallizing step with the aluminum coating or layer 8 is accomplished by means of any suitable electric or gas flame spray gun 9 to which is supplied substantially pure aluminum wire or powder. The coating 8 is applied in one or more applications with the resultant thickness of the protective disparate layer being within the range of 0.006–0.032 inch following which a seal coat 11 of any one of suitable well known compositions and which may include aluminum flakes in it, may be applied over the aluminum coating 8. The application of such a seal coat has been found to protect the initially porous coating 8 from staining while the anodic reaction occurs between the sheet interior surfaces 10 and the aluminum coating.

If the railcar R is provided with a roof (not shown) it will be understood that the interior surface thereof likewise may be aluminized similar to the car sheets as above described.

We claim:

1. A metallized freight railcar for carrying coal and the like lading, said railcar comprising a hopper car including a plurality of steel sheets each having an interior surface and all defining the limits of the hopper car interior, said steel of said sheets normally subject to corrosive and abrasive attack by said lading, a protective layer of aluminum overlying all said sheet interior surfaces, said sheet interior surfaces roughened to enhance the adherence of said aluminum layer thereto, said protective layer comprising substantially pure aluminum, said aluminum protective layer comprising a spray coated layer deposited upon all said sheet surfaces, said spray coated aluminum layer having a thickness within the range 0.006–0.032 inch, and a seal coat overlying said aluminum layer.

2. A railcar according to claim 1 wherein, said sheets comprise carbon steel.

3. A railcar according to claim 1 wherein, said sheets comprise high-strength low-alloy steel.

* * * * *